6/24/86 XR 4,596,260

United States Patent [19]

Giuliano

[11] Patent Number: 4,596,260

[45] Date of Patent: Jun. 24, 1986

[54] ARTIFICIAL NAILS

[75] Inventor: James T. Giuliano, Ft. Lauderdale, Fla.

[73] Assignee: Zotos International, Inc., Darien, Conn.

[21] Appl. No.: 671,595

[22] Filed: Nov. 15, 1984

Related U.S. Application Data

[63] Continuation-in-part of Ser. No. 522,536, Aug. 12, 1983.

[51] Int. Cl.[4] ..... A45D 40/30

[52] U.S. Cl. ..... 132/73; 350/311; 206/45.14; 424/61

[58] Field of Search ..... 132/73, 88.5; 424/61; 350/311, 1.1; 206/45.14

[56] References Cited

U.S. PATENT DOCUMENTS

| | | | |
|---|---|---|---|
| 2,633,139 | 3/1953 | Pettey | 132/73 |
| 2,746,460 | 5/1956 | Jellinek | 132/73 |
| 2,764,166 | 9/1956 | Bogoslowski | 132/73 |
| 2,979,061 | 4/1961 | Greenman et al. | 132/73 |
| 3,157,912 | 11/1964 | Lisczawka | 18/5.1 |
| 3,245,418 | 4/1966 | Dinerstein | 132/88.5 |
| 3,277,900 | 10/1966 | Lappe | 132/73 |
| 3,382,878 | 5/1968 | Dinerstein | 132/88.5 |
| 3,478,756 | 11/1969 | Sautter et al. | 132/73 |
| 3,487,831 | 1/1970 | Jaume et al. | 128/132 |
| 3,552,401 | 1/1971 | Michaelson | 132/73 |
| 3,896,014 | 7/1975 | Rosenberg | 204/159.23 |
| 3,928,113 | 12/1975 | Rosenberg | 132/73 |
| 4,058,442 | 11/1977 | Lee et al. | 204/159.12 |
| 4,104,333 | 8/1978 | Lee et al. | 260/885 |
| 4,106,614 | 8/1978 | Aylott | 206/45.14 |
| 4,132,234 | 1/1979 | Bradley | 132/73 |
| 4,156,066 | 5/1979 | Gould | 528/73 |
| 4,157,095 | 6/1979 | Sweet | 132/73 |
| 4,172,461 | 10/1979 | Pangburn | 132/73 |
| 4,260,701 | 4/1981 | Lee | 525/303 |
| 4,287,899 | 9/1981 | Robichaud | 132/73 |
| 4,408,622 | 10/1983 | Meyerhoefer | 132/73 |

*Primary Examiner*—Gregory E. McNeill

*Attorney, Agent, or Firm*—George W. Rauchfuss, Jr.

[57] ABSTRACT

Novel procedures for applying preformed artificial nail tips to provide artificial nails which are characterized as being durable, smooth and even, and as having the general appearance of natural nails, the artificial nail portion being securely adhered to the natural nail portion; and novel procedures for the "filler" maintenance of artificial nails, which procedures employ photocurable (photopolymerizable) compositions.

47 Claims, 8 Drawing Figures

ARTIFICIAL NAILS

RELATED APPLICATION

This application is a continuation-in-part of my earlier application, Ser. No. 522,536 filed Aug. 12, 1983.

BACKGROUND OF THE INVENTION

Artificial nails are well known and commonly employed, mainly by women desiring the appearance of having longer finger nails than their natural ones and/or to repair or obscure a broken nail. Generally speaking, the artificial nails of the prior art can be characterized as falling into one of the following two classes: (1) preformed nails: and (2) nails which are applied as a viscous solution or paste with the aid of a suitable form affixed to the digit during application.

As examples of preformed artificial nails, mention may be made of those described and claimed in U.S. Pat. Nos. 2,633,139; 2,746,460; 2,764,166; 2,979,061; 3,277,900; 3,487,831; 3,552,401; and 4,106,614. Generally speaking, preformed nails such as would be purchased in a package have an inadequately short life. Whether they are provided with an adhesive backing or applied with the aid of an adhesive coating composition, they tend to break off or separate from the natural nail too shortly after application. Moreover, preformed nails usually are not the precise size, particularly when one desires to apply artificial nails to less than all of the digits. In other words, they frequently do not have the "natural" look of the real nail, especially when comparison is made with the natural nail on another digit.

Consequently, virtually all artificial nails applied by professional beauticians today fall into the latter class, i.e. application by brushing or "painting" on a suitable artificial nail composition with the aid of a form secured to the digit. After the composition has hardened, the form is removed. Artificial nail procedures of this latter class are described and claimed, for example, in U.S. Pat. No. 3,478,756. In a typical procedure such as would be employed by a manicurist in a beauty salon, any existing nail polish is first removed and the nail is then lightly sanded to remove the shiny nail surface (top layer). A nail form is then placed on the finger. After the form is securely in place, a primer coating is applied to the natural nail with a small brush to increase adhesion of the applied artificial nail. After the volatile solvent for the primer has evaporated, a so-called "white tip" is then applied over the primer by first dipping the brush into a suitable organic solution, then picking up a ball or powder to form a paste which is rapidly applied in a series of steps, first on the form beyond the natural nail tip and then over the natural nail. Polymerization and hardening to form the plastic artificial nail occurs very rapidly in situ once the solution and powder are admixed and the operator must be highly skilled and move rapidly to shape this "white tip" into the desired shape of the nail. Controlling the amount of the liquid on the brush is a very critical part of this step and moreover care should be taken not to touch the natural nail with one's fingers to avoid transfer of oil and moisture which may cause the nail not to adhere properly.

Following application of the "white tip", a clear top coat of plastic is applied over the natural and artificial nails to increase the strength of the bond of the extended artificial nail to the natural nail and to give a smooth uniform appearance. The nail is then finished by removing the form, sanding, shaping, cleaning and, if desired, application of nail polish.

Because the polymerization and hardening to form the artificial nail occurs in situ shortly after admixture of the ingredients including the monomers, polymerization catalysts, etc., and the practitioner therefore has no control over the timing thereof, the artificial nails must be applied sequentially. A typical such procedure may take, for example, on the order of an hour and a half by a skilled operator to apply nails to all ten fingers.

These prior art procedures suffer from certain noted deficiencies. The operator must be trained and skilled in the shaping of the artificial nail in the short time between mixing the ingredients and hardening. As mentioned, each nail must be applied sequentially and further time is required for the finishing touches. Moreover, the known commercial procedures require the use of volatile solvents, the disadvantages of which will be readily apparent. For instance, some operators and/or their clients find the odor extremely objectionable. Technical problems may also occur. For example, occasionally the monomers in the composition do not polymerize uniformly.

In addition to the above-noted difficulties, the applied artificial nail is usually thicker in appearance and can therefore be detected on scrutiny. Further, they tend to soften the underlying natural nail. Other problems which sometimes occur include allergic reaction to the artificial nail composition, water mold, fungus, and lifting or separation of the artificial nail.

From the foregoing description of the prior art processes for preparing artificial nails, it will be seen that, although the technique of preparing the artificial nails by application of a viscous solution or paste is generally used commercially, this technique, like that of applying preformed packaged nails, suffers from certain noted deficiencies.

My aforementioned application Ser. No. 522,536 is in one aspect thereof directed to novel and improved procedures for applying artificial nails by the latter technique of coating on a viscous artificial nail solution which is then cured. These novel procedures utilize per se known organic solvent-free photopolymerizable compositions, the photopolymerization being preferably initiated in the presence of a so-called black light wherein any potentially harmful short wavelength light has been eliminated. These procedures may be employed in conjunction with any of the pre-existing forms heretofore known in the art or commercially available for the preparation of artificial nails. However, they are preferably employed in conjunction with the novel forms which are described and claimed in the application.

While the artificial nail procedures which are described and claimed in the aforementioned application Ser. No. 522,536 provide many significant advantages over the previously known techniques employing viscous coating compositions, in certain aspects they still have a disadvantage for some applications which is inherent in any in situ procedure. For instance, in any in situ procedure, one desiring an artificial nail is compelled to visualize the appearance in terms of shape and size from a form or the like and this may be difficult for some people to do. Should it turn out that the artificial nail so formed is in fact of smaller configuration than may be desired, it would ordinarily have to be removed and a new one applied. On the other hand, should it be larger than desired, sanding and/or cutting to shape is necessary. This of course is time consuming. Another factor which may be time consuming is the necessity for the client to be present during the entire procedure, including, of course, the manufacture of the artificial nail portion. In some instances, it may be more expedient for the artificial nail portion to be preselected and formed prior to the appointment with the client who need only be present, then, for the application or "gluing on" of this preformed nail to the natural nail.

Thus, it can be said that in at least certain instances, the concept of applying preformed artificial nails is inherently superior to the concept of forming the artificial nail in situ. The problem confronting practitioners of the art was that the known preformed nails were so inferior to those prepared in situ in terms of general appearance and/or durability that beauticians and manicurists always tended to employ the latter techniques.

The essential objective or task of the present invention essentially is to provide novel procedures for securing artificial nails to provide an artificial nail characterized as being durable, smooth and even, and having the general appearance of the natural nail, the artificial nail portion being securely adhered to the natural nail portion.

A primary object is to provide novel procedures employing preformed artificial nail tips, which procedures do not suffer from any of the heretofore noted deficiencies of the prior preformed nail tips while at the same time providing the advantages but not the disadvantages of the in situ formed nails.

Another object is to provide novel procedures for th "filler" maintenance of artificial nails periodically as the natural nail produces new growth.

Other objects will in part be obvious and will in part be apparent in the light of the following detailed description.

BRIEF DESCRIPTION OF THE INVENTION

Broadly speaking, one aspect of the present invention utilizes preformed artificial nail tips which are then "glued" onto the natural nail. However, unlike the prior systems utilizing preformed nail tips, e.g. those disclosed in the aforementioned patents, the present invention employs photocurable compositions and procedures as disclosed in the aforementioned copending application Ser. No. 522,536. The preformed tip is formed with such a photocurable composition or, alternatively, with a composition which will adhere well to the coating composition for applying it, placed either on or under the natural nail with its leading end extending beyond the tip of the natural nail and adhered by coating one or more layers of a photocurable composition and then curing.

Another aspect of the invention relates to the important commercial market of retouching or filling of previously applied artificial nails and/or cracked, chipped or broken natural nails. The fact that both artificial and natural nails require repair or reconstruction when cracked, chipped or broken should require no comment. Artificial nails frequently require maintenance or filling as the tip of the natural nail continues to grow. The present invention employing photopolymerizable coating compositions provides a simple and efficient procedure for repairing, retouching, filling and/or maintaining both artificial and natural nails.

DETAILED DESCRIPTION OF THE INVENTION

Figure 1:
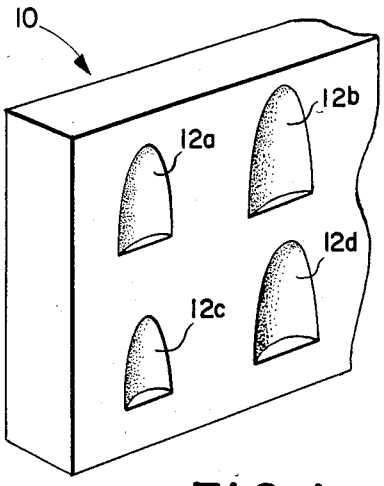
FIG. 1 is a plan view of a mold contemplated for use in the practice of the present invention.

As was previously mentioned, the present invention utilizes photopolymerizable or curable coating compositions of the type disclosed in the aforementioned parent application, Ser. No. 522,536. In general, the prior art, both the patent literature and polymer texts, is replete with reference to such compositions and they are accordingly not per se novel in the context of the present invention. Typically, these prior art compositions may include at least one suitable polymer or oligomer, a photoinitiator and a liquid monomer in which the various other ingredients are soluble, the monomer being cross-linkable with the polymer in the presence of actinic radiation, e.g. ultraviolet (UV) radiation to form the desired solid plastic. As is understood in the art, the degree of firmness is in part dependent upon the degree of cross-linking and one skilled in the art understands that varying the ratio of monomer to polymer can provide greater or lesser firmness or rigidity of the product. In general, these liquid compositions may be characterized as being solvent-free and possessing an excellent shelf life, being capable of being stored in the absence of actinic radiation for long periods of time.

The photopolymerizable compositions for use in the present invention are further characterized as being free from volatile or toxic components and they should not, of course, contain any skin irritants. Upon curing, they should provide an artificial nail which is hard but has a degree of flexibility comparable to natural nails so as to minimize the likelihood of breaking upon contact with hard objects. The cured product should also be water-insoluble and should not be affected by contact with detergents, e.g. the ordinary household detergents one typically encounters. Further, the cured product should provide a smooth, preferably shiney, uniform coating which is esthetically pleasing and will readily accept the nail polishes or lacquers customarily used. Preferably, the composition should adhere well directly to the natural nail without the aid of tie coats, base coats or the like. It should also be easily cut or sanded to shape.

All of the foregoing characteristics will be readily apparent to one skilled in the art in the light of the present description. Likewise, one skilled in the art will readily understand and appreciate the various classes of ingredients heretofore known and used in the photopolymerizable polymer art which may be selected for use in the present invention. Accordingly, these ingredients need not be discussed in any great detail.

The liquid monomers which may be used may be selected from a long list of those heretofore employed in the art, the methacrylates being particularly preferred. Included are both mono- and poly-functional monomeric materials, the latter having more reactive sites to increase the crosslink density. As will be appreciated, this is a useful way to vary the degree of hardness according to one's particular desires. Partially polymerized monomers as well as mixtures of monomers are also contemplated.

As examples of monomers heretofore employed and which may be useful, mention may be made of butanediol dimethacrylate, butoxyethyl methacrylate, butyl methacrylate, diethylaminoethyl methacrylate, diethylene glycol dimethacrylate, dimethylaminoethyl methacrylate, ethylene glycol dimethacrylate, 2-ethylhexyl methacrylate, ethoxyethyl methacrylate, glycidyl methacrylate, hydroxyethyl methacrylate, hydroxypropyl methacrylate, methyl methacrylate, neopentyl glycol dimethacrylate, polyethylene glycol dimethacrylate, tert.-butylaminoethyl methacrylate, triethylene glycol dimethacrylate, tetrahydrofufuryl methacrylate and trimethylolpropane trimethacrylate. Other monomers which may be used include acrylates such as butylene glycol diacrylate, n-butylacrylate, diethylaminoethyl acrylate, 2-ethylhexyl acrylate, ethoxyethyl acrylate, hexanediol diacrylate, polyethylene glycol diacrylate, phenoxyethyl acrylate, pentaerythritol triacrylate, trimethylolpropane triacrylate, triethylene glycol diacrylate, etc.; acrylamides such as N-isobutoxymethyl acrylamide, N-methylolacrylamide, N,N,-dimethylacrylamide, N,N,-methylene bisacrylamide, etc.; allyl monomers such as allyl glycidyl ether, allyl methacrylate, diallyl phthalate, etc.; as well as various other monomers known in the art, including vinyl monomers, glycidyl ethers and the like.

The polymers that may be used include the commercially available low molecular weight oligomers, e.g. urethanes such as those having a molecular weight ranging from about 600 to about 8000 and containing no reactive isocyanate groups, the epoxies and the polymethacrylates, the urethanes, especially the acrylated urethanes being particularly preferred. As an example of a commercially available urethane oligomer, mention may be made of "Uvithane" (trademark of Thiokol Specialty Chemical Division).

Useful photoinitiators are also well known in the art and include the aromatic ketones such as benzophenone, diethoxyacetophenone, benzil and anthraquinone; halogenated aromatic ketones such as the chlorinated benzophenones and chlorothioxanthone; as well as other well known photoinitiators.

The photopolymerizable compositions which may be employed further include the known class of acrylic adhesives characterized by a diminished sensitivity to air inhibition of thick layer curing properties and the ability to cure between surfaces regardless of the presence or absence of air. Ultraviolet light curing grades of these acrylic adhesives have been developed to provide structural bonds within seconds at room temperature on a wide variey of substrates.

The coating compositions which may be employed may include mixtures of more than one ingredient from each of the denoted groups. Additional reagents performing specific desired functions may also be added, e.g. flow control agents, slip aids and the like, as well as dyes, pigments and the like such as those heretofore used in prior art artificial nail compositions for appearance. Useful additives which may also be employed, if desired, for improving appearance include opalescence-providing materials, whitening agents, natural or synthetic pearl essence, and the like.

As examples of useful formulations, mention may be made of:

| Ingredient | Parts by Weight |
|---|---|
| Example 1 | |
| Urethane methacrylate | 60 |
| Polymethylmethacrylate | 5 |
| Trimethylolpropane trimethacrylate | 10 |
| Isobutoxymethylacrylamide | 10 |
| dimethoxyphenylacetone | 5 |
| N—Vinylpyrollidone | 10 |
| Example 2 | |
| Epoxy Methacrylate | 60 |
| Carboxyl terminated polybutadiene/acrylonitrile | 5 |
| Trimethylopropane trimethacrylate | 5 |
| N—Vinylpyrollidone | 10 |
| Bisphenol A Ethoxylate Dimethacrylate | 15 |
| Benzophenone | 5 |

It should be noted that the artificial nail compositions of the foregoing description are distinguishable both chemically and in function or use from the photocurable liquid nail lacquer compositions which are described and claimed in U.S. Pat. Nos. 3,896,014 issued July 22, 1975 and 3,928,113 issued Dec. 23, 1975. U.S. Pat. No. 3,896,014 relates to certain photocurable nail lacquers comprising a polyene, a polythiol, a photocuring rate accelerator, and a surfactant from a particular class, the composition being curable to a hard nail finish when exposed to actinic light. However, unlike the artificial nail compositions contemplated for use in the present invention, the lacquers described in the patent are readily removable by soaking the nails in warm water. They would accordingly not be useful in the practice of the present invention. While mention is made in the patent (col. 4) that the lacquer may be used without employing a base or tie coat, in the illustrative examples a tie coat was employed. U.S. Pat. No. 3,928,113, which issued from a continuation-in-part thereof, relates to a two-part nail coating system comprising as a first part (a) a basecoat composition of a water-soluble or water-swellable polymer in a solvent and as a second part (b), a photocurable nail lacquer composition as disclosed in the parent application which issued as the aforementioned U.S. Pat. No. 3,896,014. The nail polish composition is removed by placing the nails in hot water for 3–5 minutes and then peeling.

Accordingly, while relevant as further showing the state of the art, it is seen that these two patents relate to a entirely different inventive task directed to the nail polish art, the lacquers which are said to solve the task being readily removable in water and therefore not applicable for use in the present invention requiring the use of cured compositions which are far more lasting and permanent in nature, being removable with an organic solvent such as acetone, but not with water, liquid detergents and the like.

It is important to note that the present artificial nail procedures to be described in detail hereinafter are fully operative with a single coating composition of the foregoing description. They do not require a base coat for proper adhesion, nor do they require a top coat or lacquer to provide required strength or rigidity to the nail. Any coating applied thereover, specifically the nail polishes or lacquers such as those customarily purchased is only for color or appearance.

Even though the process is fully operative and useful with a single coating composition, it may be desirable, however, at least in some instances, to apply two or three coating and curing steps for a reason to be described hereinafter and the present invention accordingly contemplates the use of two or more different compositions.

It has been discovered that in some applications it is desirable and thus it is preferred to provide a first coating which on curing is more flexible and will therefore contract and expand more satisfactorily with the underlying natural nail for optimum durability. Such a coating may not, because of its greater flexibility, possess the optimum firmness and rigidity, in which event an additional photocurable coating or two of lesser flexibility, i.e. greater rigidity, may be found to be advantageous or desirable.

One skilled in the art will readily understand how to vary the liquid coating compositions to provide such variations in rigidity, i.e. how to formulate the first coating composition of greater flexibility and any additional ones of greater rigidity. As previously explained, rigidity is at least in part a function of the cross-linking which occurs during the curing step, and the extent of the cross-linking and thus the degree of rigidity may be varied by such factors as the selection of the particular oligomers and monomers, or mixtures thereof, varying the ratio of oligomer to monomer content, and the selection of monomers which are mono-, di-or polyfunctional and therefore have varying degrees of reactive sites for cross-linking.

As was mentioned previously, a primary object of this invention is to provide novel procedures for applying preformed artificial nail tips to digits, which procedures do not suffer from any of the disadvantages in appearance or adhesion common to the prior art packaged or preformed nail tips.

In accordance with the present invention, the artificial nail tip is adhered to the natural nail with a photopolymerizable coating composition as detailed previously. After the coating composition is applied, as will be described below with reference to the illustrative drawings, the thus coated digit is subjected to actinic radiation, preferably UV light, to effect curing which in turn produces the desired artificial nail.

Obviously, the preformed nail tip may be made from the same or similar photopolymerizable composition. However, it should be appreciated that it need not be. It may instead be made from a wide variety of plastic compositions provided they are compatible with the photopolymerizable coating composition employed to adhere it to the natural nail.

As used herein and in the appended claims, the term "compatible" means a material which will adhere well and provide a strong, durable bond on curing and, moreover, will not react adversely with the coating to cause spotting, blistering or other disfunctional or unsightly effects. Stated conversely, an artificial nail material which does not adhere strongly is incompatible and therefore not within the scope of the term "compatible" as used herein.

Suitable plastics for forming the artificial nail tips include those made from the aforementioned list of polymers and/or monomers. However, polymerization can be initiated in the more usual way, e.g. with the aid of polymerization catalysts and the like, rather than by means of photoinitiators and exposure to actinic light.

It is really not feasible to define the nail tips which can be used and those which cannot any more definitively. The ones which are "compatible" and can therefore be used should be apparent to those skilled in the art and, in any event, they can be determined readily by routine experimentation. The coating composition can be applied to the test nail tip substrate and then cured to determine if the bond is of the requisite strength and durability and does not readily separate. Any adverse effects to the appearance, e.g. blistering, can obviously be ascertained by visual inspection.

While in theory, the coated digit can be subjected to various types of actinic radiation to initiate curing, from the standpoint of practicality and, above all, safety, the types of radiation which can be employed is of course not so varied. As mentioned, the preferred source of curing radiation is UV light. Even then, not all sources of UV are feasible.

While theoretically, any of the light sources including the commercially available UV lights can be employed, it will be appreciated that care must be taken to avoid any harmful effects from the radiation to either the operator or the person to whom the nails are being applied. For this reason, an important aspect of the invention, in its most preferred form, is the use of a so-called blacklight which emits radiation in specific range of the spectrum to obviate any dangers inherent in the use of UV.

To fully understand this preferred aspect of the invention, it is appropriate briefly to discuss ultraviolet radiation in general.

Ultraviolet light, or more correctly, ultraviolet radiation, is a form of energy that occupies a small region of the electromagnetic spectrum. This spectrum ranges from the highest energy (shortest wavelength) cosmic rays to the lowest energy (longest wavelength) radio waves. UV, which is at the near end of the visible spectrum, has been commonly divided into three regions: (1) short wavelength (UV-C) ranging from 180 to 280 nm; (2) medium wavelength (UV-B) ranging from 280 to 320 nm; and (3) wavelength (UV-A) ranging from 320 to 380 nm. While lamps producing ultraviolet radiation in all three of these regions are commercially available, it is well known that safety precautions should be observed near and around sources of short wave (UV-C) or medium wave (UV-B) radiation. Failure to protect the eyes and skin can result in discomfort such as painful "sunburning".

Long wavelength (UV-A), also referred to as nearultraviolet, is often called "Blacklight" because of its capability of exciting various substances, causing them to fluoresce. Blacklight energy is generally regarded as not being harmful. However, blacklight energy alone (without visible light) from blacklight lamps causes the eye media to fluoresce, producing sensations that have been described as unusual or uncomfortable. This fluorescence of the eye media is temporary, existing for the time of exposure and producing no known after effects. While it is generally accepted that normal levels of blacklight energy are not harmful to the average, healthy person, abnormally high levels of energy, long term exposure, abnormal sensitivity or abnormal sensitivity provided by sensitizing agents (drugs or chemicals) to this energy may produce eye and/or skin irritations.

Figure 6:
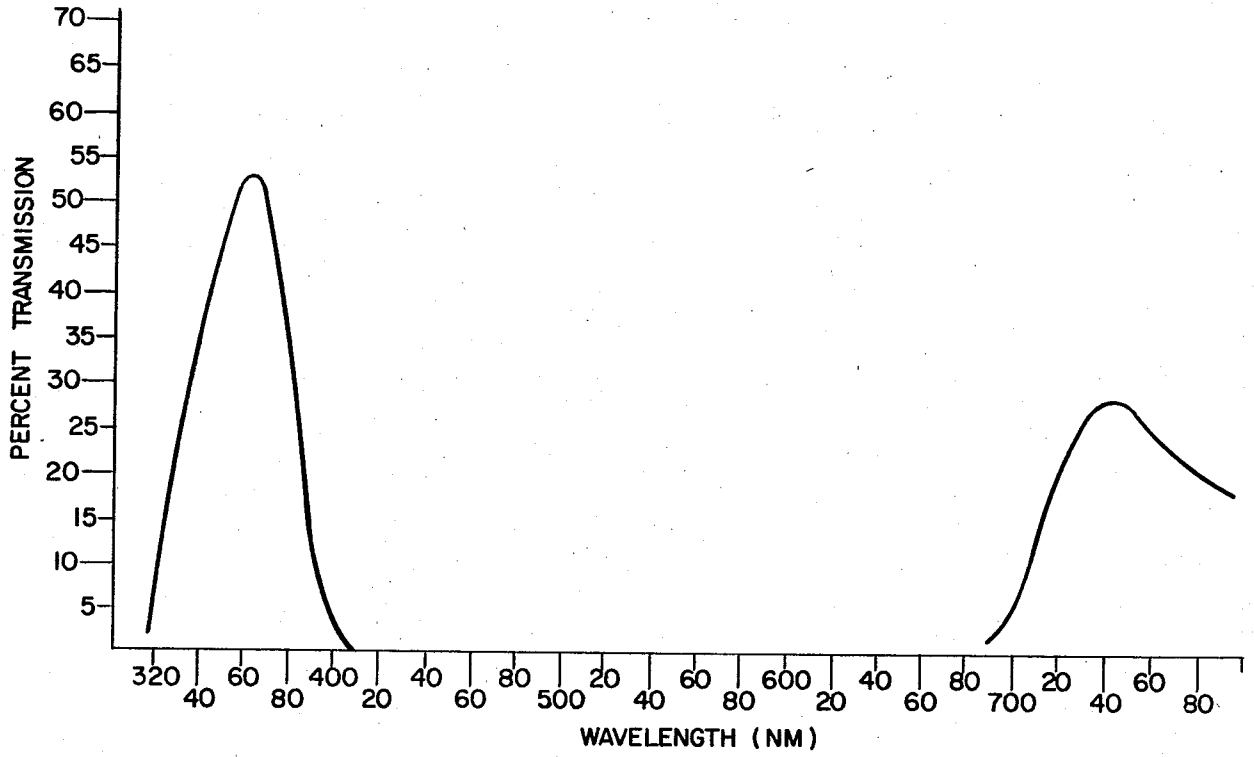
FIG. 6 is a graph showing the spectral transmittance curve of a preferred curing lamp in accordance with this invention.

Accordingly, in the preferred application of the curing step, a blacklight lamp is used which provides a wavelength of essentially around 360 nm for the curing radiation, visible light, heat, and the short and medium wavelength UV being effectively eliminated. More specifically, a blacklight lamp such as would be commercially available, e.g. an industrial UV spot lamp having a 100 watt capacity or rating may be provided with a glass filter of known composition adapted to transmit radiation emanating from the lamp having a spectral transmittance curve exhibiting a peak of about 360 nm and a sharp cut-off with tails extending only to about 320 and about 400 nm. Preferably, the glass absorption filter (e.g. on ining blue-black coloring agents) will, as shown in the transmittance curve of FIG. 6, transmit in excess of 50% of the actinic radiation at the peak of about 360 nm; no more than about 20% of the radiation at 330 nm and 390 nm; no more than about 5% of the radiation at 320 nm and 400 nm. In addition, less than 10% of the near infrared below 700 nm will be transmitted. While glass absorption filters which can provide this kind of spectral transmittance will be understood in the optical art and need not be further described in detail, in general a useful glass absorption filter for use with the contemplated curing lamps may be round, have a diameter of about five inches and a sample thickness of about 3/16 inch, and a coefficient of expansion of about $53\times10^{-7}$.

With the foregoing detailed background description in mind, the preparation of artificial nail tips will now be described with reference to the accompanying drawings, FIGS. 1–5.

To fully appreciate the nature and advantages of this invention, for purposes of this discussion reference will be made to a typical beauty salon having one or more manicurists with a substantial clientele for manicures and the manufacture and maintenance of artificial nails. These manicurists are fairly busy and visits are customarily by appointment only. Obviously, their income is entirely dependent upon the number of appointments they can make.

In the contemplated practice of this invention in such a typical establishment, the salon may purchase and maintain an inventory of various sizes and shapes of nail tips. However, the inherent problems of maintaining an inventory along with the danger of finding a particular nail tip out of stock when needed may make it undesirable to purchase such a variety of nail tips. Accordingly, it is contemplated that the salon may, if desired, be provided with a suitable mold or form for making its own nail tips as it wishes.

A portion or broken section of such a mold is shown in FIG. 1. Mold 10, which is shown to be generally rectangular, but may of course be of any desired shape, has a number of wells or recessed areas conforming to the shapes and thicknesses of the different nail tips sought to be manufactured. In the partial view of FIG. 1, only four such wells, 12*a, b, c,* and *d* are shown. In a typical mold envisioned by this invention, 10 or more wells adapted for the manufacture of a like number of varying nail tips might actually be provided to minimize the shaping which may be required after the nail tip is applied to the digit.

Mold 10, or at least the wells thereof, is preferably made of a material to which the cured photopolymerizable composition will not adhere and can instead be easily peeled away after the nail tip is formed. As examples of such materials, mention may be made of silicone and polyesters such as polypropylene and polyethylene. Alternatively, it will be apparent that at least wells 12 can be coated with a suitable material, e.g. silicone, to provide a substrate to which the cured nail tip will not adhere.

In operation, the desired well 12 of mold 10 may be filled with the polymerizable composition and curing is then initiated by subjecting the thus filled wells to actinic radiation. As will be appreciated, in this step for forming the nail tip, it is not necessary to utilize UV light, e.g. the blacklight of the aforementioned description. Obviously, other light sources for the curing radiation may be employed.

While the nail tip may be formed from a single coating, it is also contemplated that two or more coatings of varying degrees of rigidity may be employed to form the nail tip, the more flexible (less rigid) coating being on the surface to adhere to the natural nail. For example, a first more rigid coating composition may be inserted in the well to cover less than its full depth and cured. After curing, one or more additional compositions of greater flexibility may be added and cured successively to form the nail tip.

Modifications of the above-mentioned procedures for forming the nail tips will also be apparent in view of the foregoing description. For example, as was mentioned previously, the nail tip need not be formed from photopolymerizable compositions. The nail tip must only be made of a material which is "compatible" with the photopolymerizable coating composition employed to adhere the nail tip to the natural nail. Accordingly, one or more compositions of the more conventional type containing polymerization catalysts or initiators may be employed with mold 10 to provide the nail tip. Alternately, the well 12 may be in part filled with such a composition and cured and in part with a photopolymerizable composition and cured to form a nail tip which is a laminate of the aforementioned different compositions. The only requisite, as noted previously, is that a compatible laminate is provided wherein the respective strata are securely bonded. These modifications are within the expected judgment of the skilled worker in the light of this description and need not be discussed in further detail.

A significant advantage of preformed nail tips, whether purchased in bulk or manufactured in the salon with the aid of a suitable mold such as shown in FIG. 1, is that the client need not be present during the manufacture. Records may be kept for individual clients and the desired number of tips can be provided and available prior to the individual client's appointment. This may be a significant convenience to the client as well as a substantial time-saver for the salon.

FIGS. 2–5 illustrate the application of the nail tip to the digit. In the embodiment illustrated therein, the nail tip is shown to be adhered over the natural nail.

Figure 2:
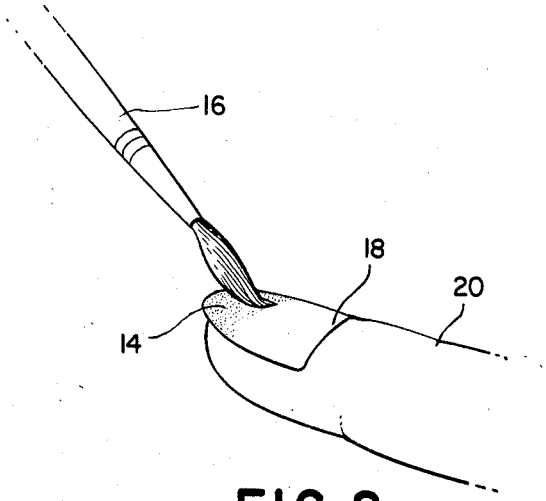
FIG. 2 is a perspective view of the initial step in adhereing a preformed artificial nail in accordance with this invention.

As shown in FIG. 2, the photopolymerizable coating 14 is applied with the aid of a brush or the like 16 to at least the surface of the forward end of the natural nail 18 of digit 20 which is to be overlapped by the nail tip.

Figure 3:
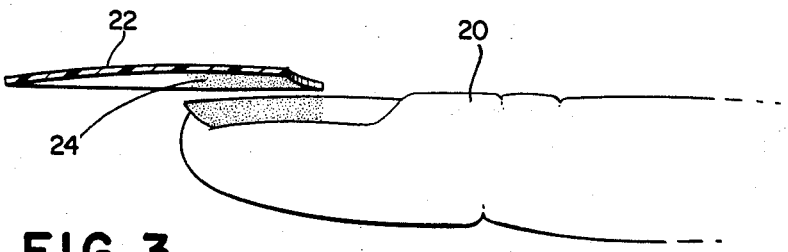
FIG. 3 is a sectional elevational view showing the step of applying the artificial nail tip to the natural nail.

With reference to FIG. 3, the underside of the artificial nail tip 22, or at least the portion thereof to be placed in juxtaposition with the natural nail is coated with the same or a similar photopolymerizable composition 24 and the nail tip 22 is then positioned on digit 20 with the coated surfaces 14, 24 in contact. Curing is then effected, e.g. with the aforementioned blacklight, to secure the artificial nail tip 22 to the natural nail 18.

Figure 4:
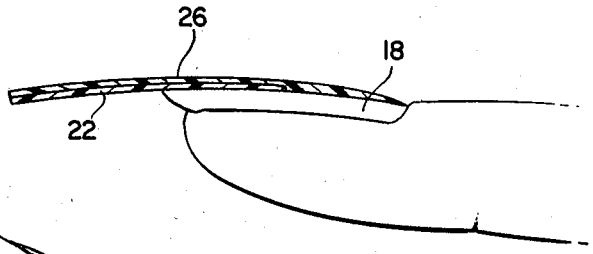
FIG. 4 is a similar view showing the artificial nail after application of the continuous coating.
Figure 5:
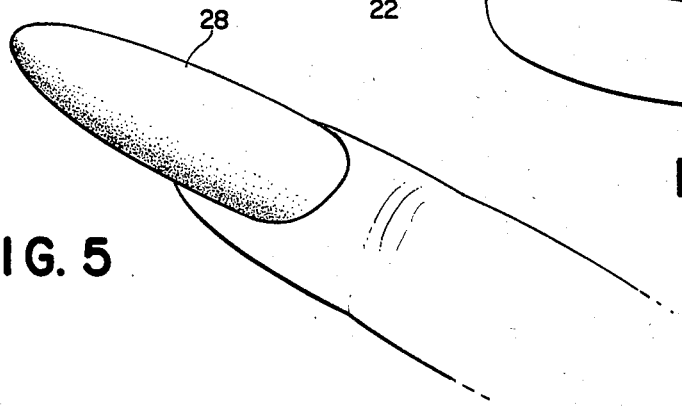
FIG. 5 is a perspective view showing the digit of FIG. 2 completion of preparing the artificial nail.

As shown in FIG. 4, an additional photopolymerizable coating 26 (which may be the same as coatings 14,24 or different) is then applied in a smooth uniform layer over the surface of the nail tip and any exposed natural nail surface, followed by curing in the described manner to provide the desired artificial nail 28, as shown in FIG. 5. Nail 28 may then, if desired, subjected to the usual finishing steps for grooming the nail, including cutting or sanding to shape and the application of nail polishes or the like. These additional steps are optional for cosmetic purposes, rather than being essential to the practice of the invention.

In the foregoing embodiment shown in the illustrative drawing, the artificial nail tip is secured over the natural nail, i.e. is superposed on the outer or top surface of the natural nail. However, it is also contemplated that the artificial nail tip may be secured under the tip of the natural nail. To do so, essentially the same procedures would be followed as those mentioned above.

The top surface of the trailing end portion of the artificial tip and the underside of the tip of the natural nail are coated with a photopolymerizable composition, as described. The artificial nail is then placed under the tip of the natural nail with the respective coated surfaces in contact, care of course being taken to be sure the artifical tip is properly aligned and fits evenly with the natural nail. While maintaining this alignment, curing is then effected to secure the artificial tip. A second coating is then applied to fill in and level the depth and to provide a continuous smooth, even coating on the outer or top surface, extending from the tip of the artificial nail to the trailing end portion of the natural nail. Curing will then provide an artificial nail having the general appearance as shown in FIG. 5.

It will be appreciated, however, that in this instance adhesion to the natural nail is provided in part by the adhesive coating on the underside of the tip of the natural nail and in part by the continuous adhesive coating extending throughout the outer surface of both the artificial tip and the natural nail. The resulting artificial nail may more visually approximate the appearance of a natural nail in some instances, without the "bump" which can sometimes appear in the overlapping embodiment shown in the drawing where the final coating composition is feathered from the trailing end of the artificial tip towards its leading end and towards the trailing end or cuticle of the natural nail.

In a particularly preferred aspect of this embodiment of the invention, the trailing end portion of the artificial nail tip adapted to be positioned under the tip of the natural nail is recessed to a lesser thickness or depth, so that when the artificial tip is placed with this recessed area under the natural nail with the trailing end of the artificial tip substantially abutting the tip of the digit, the outer surface of the artificial tip is substantially even or flush with the outer surface of the natural nail. This aspect of the invention is illustrated in FIGS. 7 and 8.

As shown therein, artificial nail tip 22*a* has a leading end 32, trailing end 34 and lateral edges 36, 38. Leading end 32 is generally arcuate to conform essentially to the contemplated final shape of the artificial nail tip and trailing end 34 is also generally arcuate to conform essentially to the shape of the tip of the digit. Nail tip 22*a* has a trailing section 40 adapted to fit under the tip of the natural nail. Trailing section 40, which extends throughout the width between lateral edges 36,38 from the trailing end 34 a short distance forward, e.g. on the order of 2–4 mm., towards the leading end 32, is recessed or notched so as to be thinner, e.g. on the order of a mm. thinner, than at least the medial portion of the artificial tip immediately adjacent the trailing portion.

Figure 7:
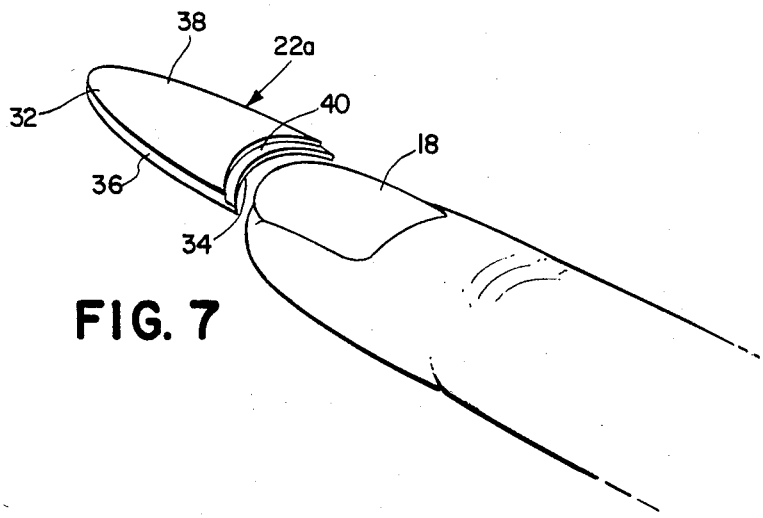
FIG. 7 is a perspective view of the initial step of positioning a preformed artificial nail tip in accordance with an alternate embodiment of the invention.
Figure 8:
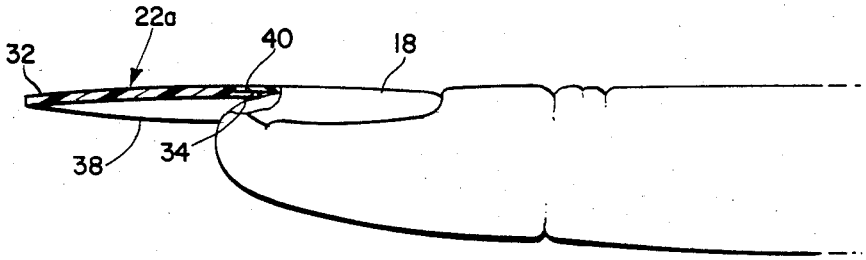
FIG. 8 is a sectional view showing completion of the alternate embodiment of FIG. 7.

As shown in FIG. 7, when artificial tip 22*a* is positioned for application to the digit with the trailing portion underlying the natural nail 18, the outer surfaces of artificial tip 22*a* and natural nail 18 are substantially in the same plane, i.e. are substantially flush or even. Upon adhesion with a photopolymerizable composition in the described manner, the resulting artificial nail appears visually to be of substantially uniform thickness so as to be visually indistinguishable from a natural nail.

Throughout the description of the illustrative drawings, reference has been made to adhering the artificial nail tip with a single coating composition. However, as previously mentioned, the invention also contemplates the use of two or more compositions which are substantially the same, but upon curing posses varying degrees of rigidity.

To illustrate this contemplated procedure, one varies the coating composition, e.g. the compositions in the illustrative examples, to provide three compositions of varying degrees of rigidity: (1) a relatively more flexible one; (2) a second medium one of more rigidity; and (3) a third composition more rigid than the second.

With reference again to FIGS. 1–5, coating (3) is brushed into mold 12 to less than its full depth, e.g. less than one-third of the depth, and cured. After curing, coating (2) is added and cured to fill say, for example, two-thirds of the mold; and, finally, coating (1) is added to fill the mold and then cured to provide a solid artificial nail tip 22 consisting of a laminate of the three coatings. The first, more flexible coating is then applied to the natural nail (FIG. 2) and cured. Next, the medium coating (2) is applied both over the cured coating (1) on the natural nail and to the underside of the artificial tip which is then placed in position on the digit with the respective coated surfaces in contact (FIG. 3). The artificial tip is then fused and laminated to the natural nail by curing. Finally, the more rigid coating (3) is applied over the entire artificial nail tip and any natural nail (FIG. 4) and cured to provide the artificial nail (FIG. 5).

In a modification of this multiple coating alternate procedure, it is contemplated that coatings (2) and (3) can be admixed, e.g. in a 50—50 mixture, to provide what can be termed a two-coating procedure.

As was mentioned earlier, the present invention also contemplates novel procedures for the repair or upkeep of artificial nails.

To recapitulate, artificial nails are generally prepared by one of the following two techniques: (1) gluing on preformed nails; or (2) forming the artificial nail from a viscous coating solution which is painted onto the natural nail in the general shape desired and then polymerized to form the hard artificial nail. The latter concept is sometimes referred to in the trade as "sculptured nails", because the nail is sculptured on the digit from the applied polymerizable composition.

Regardless of its method of formation, the artificial nail will require upkeep or repair from time to time. Obviously, no matter how strongly they are adhered or how tough and durable they may be, they can become broken or cracked through accident. Even if no such damage occurs, periodic maintenance is required due to new growth of the natural nail. Typically, about every two weeks or so the new growth on the underlying nail requires the client to come in for what is known as a "fill in" or "filler". A substantial market has developed for this maintenance and/or fill in in your typical beauty salon, e.g. the hypothetical one mentioned earlier.

While basically the maintenance or fill in procedures sound simple and merely involve the steps needed to apply a uniform continuous coating over the new growth and the surface of the existing nail, to understand fully the significance of the present invention in this substantial trade, it is appropriate to review typical procedures prior to the present invention and the invention described and claimed in the parent application, Ser. No. 522,536.

As was mentioned earlier in the discussion of the "Background of the Invention", the typical procedures for preparing artificial nails in beauty salons employ organic solutions of polymerizable ingredients along with an activator or polymerization catalysts in the sculptured nail technique. These procedures are rather time consuming and require the nails be made sequentially, due to the fact that the operator has no control over polymerization which occurs rapidly in situ once the ingredients are all in solution. Other problems, including the use of organic solvents, have also been noted.

The problems inherent in the use of such compositions in the preparation of artificial nails are also inherent in the use of these compositions in upkeep and maintenance after the nail has been applied.

The present invention provides a rapid and simple technique for these maintenance procedures, assuming, as mentioned before, the artificial nail to be treated is made of a "compatible" material.

In accordance with this invention, the photopolymerizable composition is simply applied to the surface of the nail and any new growth on the natural nail. Curing under UV in the described manner will fuse the new coating to the previously applied nail, giving the appearance of a natural nail.

In view of the foregoing description, it will be apparent that the present invention affords many significant advantages to the beauty salon or the practitioners of the art of preparing and maintaining artificial nails.

The major advantage are the time factor and the fact that organic solvents are not employed. With respect to the time factor advantage, the present invention permits one to adhere the artificial nail and/or maintain it appreciably faster, even if only one nail is contemplated or two or more are applied or treated sequentially. A further advantage in time is obtained by the ability to treat a plurality of digits concurrently. This is an extremely important aspect of the present invention. Since the operator has control over the time of polymerization, it is not necessary that the individual digits be treated sequentially.

To illustrate this point, assume that the client, a regular one, calls the hypothetical beauty salon and request an appointment to have three new artificial nails applied and two previously applied ones filled in for new growth. The operator checks the client's records and has the desired three artificial nail tips awaiting the appointment. The procedures described above with respect to FIGS. 2–5 are performed concurrently for all three digits for the new artificial nails. In other words, all three digits are coated along with the three nail tips, after which the three nail tips are applied and cured simultaneously, as described. At the same time, the two digits are given the fill in treatment, so that the five digits, which may be on the same or different hands, are treated under the UV curing lamp at the same time. This in turn affords a very significant saving in time for the operator as well as a decided convenience to the client.

Although the invention has been described in detail in the foregoing specification along with the accompanying drawings with respect to the various embodiments thereof, these are intended to be illustrative only and not limiting. One skilled in the art will recognize that various modifications and variations may be made therein which are within the spirit of the invention and the scope of the appended claims.

What is claimed is:

1. In a process wherein a preformed artificial nail tip is adhered to the natural nail tip of a digit and at some time thereafter a continuous coating is applied over the surface of said artificial nail tip and at least a portion of the exposed surface of said natural nail, whereby to give the appearance of a natural nail; the improvement comprising the steps of: (1) employing as said continuous coating an organic solvent-free photocurable liquid composition which upon exposure to actinic radiation can cure to provide a hard, flexible water-insoluble plastic; and (2) thereafter exposing said applied photocurable composition to actinic radiation to initiate said curing.

2. A process as defined in claim 1 wherein said actinic radiation is ultraviolet light.

3. A process as defined in claim 2 wherein said ultraviolet light is essentially long wavelength in the range of from about 320 to about 380 nm.

4. A process as defined in claim 1 wherein said actinic radiation is provided by placing the digit under a blacklight lamp which emits radiation characterized as being effectively free of visible light, heat, and short and medium wavelength ultraviolet light, said emitted radiation being essentially long wavelength ultraviolet.

5. A process as defined in claim 4 wherein said lamp contains an absorption filter which transmits in excess of 50 percent of the actinic light emanating from said lamp at 360 nm, no more than 20 percent of the radiation emanating at about 330 nm and about 390 nm, no more than about 5 percent of the radiation emanating at about 320 nm and about 400 nm and less than 10 percent of the near infrared below about 700 nm.

6. A process as defined in claim 1 wherein said photocurable liquid composition is applied successively to the artificial and natural nails on a plurality of said digits whereby to provide said continuous coating on each said digit; and said digits having the thus applied composition are than concurrently exposed to said actinic radiation, whereby to effect simultaneous curing of said composition on each said digit.

7. A process as defined in claim 1 including the further steps of applying at least one additional organic solvent-free photocurable composition over said first-mentioned cured photocurable composition; and thereafter exposing each said additional composition successively to actinic radiation, whereby to provide a plurality of said continuous coatings.

8. A process as defined in claim 7 wherein each said additional photocurable composition is characterized as possessing greater rigidity upon curing than said first-mentioned composition.

9. A process as defined in claim 1 wherein said composition includes at least one polymer, a photoinitiator, and at least one monomer in which said polymer and said photoinitiator are soluble, said monomer being cross-linkable with said polymer in the presence of said actinic radiation.

10. A process as defined in claim 9 wherein said polymer is a low molecular weight acrylated urethane oligomer free of reactive isocyanate groups.

11. A process as defined in claim 10 wherein said composition further includes at least one reagent selected from the group consisting of flow control agents, slip aids, dyes and pigments.

12. A process as difined in claim 1 wherein said artificial nail tip is composed essentially of a cured photocurable composition.

13. A process as defined in claim 12 wherein said composition forming said artificial nail tip and said applied photocurable composition are substantially the same.

14. A process as defined in claim 1 wherein said artificial nail tip is adhered to said natural nail by coating the opposed surfaces of said artificial and natural nails with an organic solvent-free photocurable liquid composition which upon exposure to actinic radiation can cure to provide a hard, flexible water-insoluble plastic; placing said coated surfaces of said nails in superposition; and thereafter exposing said superposed coated nails to actinic radiation to initiate said curing.

15. A process for preparing artificial nails by applying a preformed artificial nail tip to the natural nail tip of a digit, said process comprising the steps of coating at least a portion of one surface of each of said artificial nail tip and said natural nail tip with an organic solvent-free photocurable liquid composition which upon exposure to actinic radiation can cure to provide a hard, flexible water-insoluble plastic; placing said artificial and natural nail tips in overlapping relationship with said respective coated portions contacting one another; and thereafter exposing said coated portions of said artificial and natural nails to actinic radiation to initiate curing, said artificial nail tip being composed essentially of a material compatible with said photocurable composition, whereby, upon curing, said artificial nail tip is adhered to said natural nail.

16. A process as defined in claim 15 including the further steps of applying over the upper surface of exposed portions of said natural nail and adhered artificial nail tip a continuous coating of an organic solvent-free photocurable liquid composition which upon exposure to actinic radiation can cure to provide a hard, flexible water-insoluble plastic; and thereafter exposing said applied coating to actinic radiation to initiate said curing and thereby provide a natural appearance to said artificial nail.

17. A process as defined in claim 16 wherein said actinic radiation in each said step of exposure to actinic radiation is ultraviolet light.

18. A process as defined in claim 17 wherein said ultraviolet light is essentially long wavelength in the range of from about 320 to about 380 nm.

19. A process as defined in claim 17 wherein said actinic radiation is provided by placing said digit under a blacklight lamp which emits radiation characterized as being effectively free of visible light, heat, and short and medium wavelength ultraviolet light, said emitted radiation being essentially long wavelength ultraviolet.

20. A process as defined in claim 19 wherein said lamp contains an absorption filter which transmits in excess of 50 percent of the actinic radiation emanating from said lamp at 360 nm, no more than 20 percent of the radiation emanating at about 330 nm and about 390 nm, no more than about 5 percent of the radiation emanating at about 320 nm and about 400 nm and less than 10 percent of the near infrared below about 700 nm.

21. A process as defined in claim 16 wherein each said composition includes at least one polymer, a photoinitiator, and at least one monomer in which said polymer and said photoinitiator are soluble, said monomer being cross-linkable with said polymer in the presence of said actinic radiation.

22. A process as defined in claim 16 including the further steps of successively applying at least one additional organic solvent-free photocurable composition as a continuous layer over said first-mentioned cured continuous coating and then exposing to actinic radiation to cure each said additional coating.

23. A process as defined in claim 22 wherein each said additional photocurable composition is characterized as possessing greater rigidity upon curing than the underlying coating layer.

24. A process as defined in claim 16 wherein said artificial nail tip is composed essentially of a cured photocurable composition.

25. A process as defined in claim 24 wherein said composition forming said artificial nail tip, said composition adhering said artificial nail tip to said natural nail and said continuous coating composition are substantially the same.

26. A process as defined in claim 21 wherein said polymer is a low molecular weight acrylated urethane oligomer free of reactive isocyanate groups.

27. A process for preparing artificial nail tips for a plurality of digits, each said digit having a natural nail, said process comprising the steps of: (1) providing a plurality of preformed artificial nail tips to be applied consecutively with one said tip for each said digit; (2) coating at least a portion of one surface of each said artificial nail tip to be applied and each said natural nail with an organic solvent-free photocurable liquid composition which upon curing by exposure to actinic radiation will provide a hard, flexible, water-insoluble plastic; (3) placing one of said artificial nails in overlapping relationship with the natural nail on each of said digits with said respective coated portions contacting one another; and (4) thereafter exposing said coated portions of said artificial and natural nails on each said digit to actinic radiation to initiate curing, said artificial nail tips each being composed essentially of a material compatible with said photocurable composition, whereby, upon curing, one of said artificial nail tips is adhered to the natural nail on each said digit.

28. A process as defined in claim 27 including the further steps of consecutively applying over the upper surface of exposed portions of said natural and adhered artificial nail tip on each said digit a continuous coating of an organic solvent-free photocurable liquid composition which upon exposure to actinic radiation can cure to provide a hard, flexible, water-insoluble plastic; and thereafter exposing said applied coating on each said digit to actinic radiation to initiate said curing and thereby provide a natural appearance to said artificial nail on each said digit.

29. A process as defined in claim 28 wherein said first-mentioned curing step for each said digit is performed simultaneously.

30. A process as defined in claim 29 wherein said last-mentioned curing step for each said digit is performed simultaneously.

31. A process for maintaining a previously prepared artificial nail which has been adhered to the natural nail of a digit and thereafter a continuous layer of a plastic material has been applied over said artificial and natural nails to provide said artificial nail, said process comprising the steps of applying as a continuous coating over said artificial nail and any new growth of said natural nail, an organic solvent-free photocurable liquid composition which upon exposure to actinic radiation can cure to provide a hard, flexible, water-insoluble plastic; and thereafter exposing said photocurable composition to actinic radiation to initiate said curing, said artificial nail being compatible with said composition, whereby said cured composition is securely adhered to said artificial nail and provides a natural appearance to said artificial nail.

32. A process as defined in claim 31 wherein said actinic radiation is ultraviolet light.

33. A process as defined in claim 32 wherein said ultraviolet light is essentially long wavelength in the range of from about 320 to about 380 nm.

34. A process as defined in claim 31 wherein said actinic radiation is provided by placing the digit under a blacklight lamp which emits radiation characterized as being effectively free of visible light, heat, and short and medium wavelength ultraviolet light, said emitted radiation being essentially long wavelength ultraviolet.

35. A process as defined in claim 34 wherein said lamp contains an absorption filter which transmits in excess of 50 percent of the actinic light emanating from said lamp at about 360 nm, no more than 20 percent of the radiation emanating at about 330 nm and about 390 nm, no more than about 5 percent of the radiation emanating at about 320 nm and about 400 nm and less than 10 percent of the near infrared below about 700 nm.

36. A process as defined in claim 31 wherein said photocurable composition is applied successively to the artificial nails on a plurality of said digits whereby to provide said continuous coating on each said digit; and said digits having the thus applied composition are then concurrently exposed to said actinic radiation, whereby to effect simultaneous curing of said composition of each said digit.

37. A process as defined in claim 31 including the further steps of applying at least one additional organic solvent-free photocurable composition over said first-mentioned cured photocurable composition; and thereafter exposing each said additional composition successively to actinic radiation, whereby to provide a plurality of said continuous coatings.

38. A process as defined in claim 37 wherein each said additional photocurable composition is characterized as possessing greater rigidity upon curing than said first-mentioned composition.

39. A process as defined in claim 31 wherein said composition includes at least one polymer, a photoinitiator, and at least one monomer in which said polymer and said photoinitiator are soluble, said monomer being cross-linkable with said polymer in the presence of said actinic radiation.

40. A process as defined in claim 39 wherein said polymer is a low molecular weight acrylated urethane oligomer free of reactive isocyanate groups.

41. A process as defined in claim 31 wherein said artificial nail is composed essentially of a cured photocurable composition.

42. A process as defined in claim 41 wherein said composition forming said artificial nail and said applied photocurable composition are substantially the same.

43. A process for preparing artificial nails by applying a preformed artificial nail tip to a natural nail tip of a digit, said process comprising the steps of:

(1) providing a preformed artificial nail to be applied to a natural nail tip of a digit, said artificial nail having an arcuate leading edge conforming essentially to the contemplated final shape of the artificial nail tip, lateral edges and a recessed generally arcuate trailing end portion having a trailing edge conforming essentially to the shape of the natural nail tip of the digit;

(2) placing the recessed trailing end portion of said artificial nail tip under the natural nail with the trailing end of the artificial tip substantially abutting the tip of the digit such that the outer surfaces of the artificial nail tip and the natural nail tip are substantially in the same plane;

(3) coating said artificial nail tip and said natural nail tip with an organic-solvent-free photocurable liquid composition which upon curing by exposure to actinic radiation will provide a hard, flexible, water-insoluble plastic;

(4) thereafter exposing said coated artificial and natural nails to actinic radiations to initiate curing whereby the resulting artificial nail appears visually to be of substantially uniform thickness.

44. A process as defined in claim 43 wherein said actinic radiation is provided by placing the digit under a blacklight lamp which emits radiation characterized as being effectively free of visible light, heat and short and medium wavelength ultraviolet light, said emitted radiation being essentially long wavelength ultraviolet.

45. A process as defined in claim 44 wherein said composition includes at least one polymer, a photoinitiator, and at least one monomer in which said polymer and said photoinitiator are soluble, said monomer being cross-linkable with said polymer in the presence of actinic radiation.

46. A process as defined in claim 45 wherein the polymer is a low molecular weight acrylated urethane oligomer, free of reactive isocyanate groups.

47. A process as defined in claim 46 wherein the acrylated urethane oligomer has a molecular weight ranging from about 600 to about 8000.

* * * * *